US005432691A

United States Patent [19]

Garrett et al.

[11] Patent Number: 5,432,691

[45] Date of Patent: Jul. 11, 1995

[54] AUTOMATED TRUSS MODULE WITH DEPLOYMENT MECHANISM

[75] Inventors: Randall D. Garrett, Dallas; Bradley D. Ellis, Balch Springs, both of Tex.

[73] Assignee: Vari-Lite, Inc., Dallas, Tex.

[21] Appl. No.: 179,537

[22] Filed: Jan. 10, 1994

Related U.S. Application Data

[63] Continuation-in-part of Ser. No. 978,267, Nov. 18, 1992, Pat. No. 5,278,742.

[51] Int. Cl.[6] ..... F21V 1/00

[52] U.S. Cl. ..... 362/233; 362/239; 362/250

[58] Field of Search ..... 362/233, 238–240, 362/249, 250, 390, 418

[56] References Cited

U.S. PATENT DOCUMENTS

| | | | |
|---|---|---|---|
| 3,495,364 | 5/1967 | De Bella . | |
| 4,167,783 | 9/1979 | Mitchell . | |
| 4,319,311 | 3/1982 | Mitchell . | |
| 4,523,256 | 6/1985 | Small . | |
| 4,837,665 | 6/1989 | Hoyer et al. . | |
| 4,862,336 | 8/1989 | Richardson et al. . | |
| 5,278,742 | 1/1994 | Garrett | 362/233 |

*Primary Examiner*—Carroll B. Dority
*Attorney, Agent, or Firm*—Morgan & Finnegan

[57] ABSTRACT

A lighting truss utilizes a drive assembly to facilitate movement of lighting instruments between a protected transport position and a deployed position, extending the lighting instruments below the truss for operation. Once deployed, means are provided for spreading the lighting instruments apart from one another to allow unimpeded pan and tilt operation of the lighting instruments and allow for storage of the lighting instruments in a relatively small truss.

15 Claims, 16 Drawing Sheets

AUTOMATED TRUSS MODULE WITH DEPLOYMENT MECHANISM

This application is a continuation-in-part of U.S. patent application Ser. No. 07/978,267 filed Nov. 18, 1992, now U.S. Pat. No. 5,278,742.

TECHNICAL FIELD

The present invention relates generally to support structures for lighting equipment, and more particularly, to a truss system suitable for mounting, transporting and deploying lighting instruments.

BACKGROUND OF THE INVENTION

The lighting systems associated with a travelling concert tour must be easily transported from one performance venue to another. An illustrative lighting system is the Vari-Lite Series 200, with its VL2, VL3, VL4 and VL5 lamp configurations. Modern systems, often comprised of lighting instruments having sensitive optical components, are typically disassembled between performances and transported in specially designed protective containers, such as those described in copending patent application Ser. No. 940,663, filed Sept. 4, 1992, that permit the sensitive instruments to withstand the rigors associated with transport.

Accordingly, a typical lighting system, upon arrival at each performance venue, must be erected prior to each performance. To accomplish this labor-intensive task, the various sections that comprise the truss assembly must be unloaded from the truck and assembled inside the venue in the required configuration. Thereafter, the truss assembly is raised to a height of about four feet above the venue floor to facilitate the hanging of the lighting instruments on the truss assembly. Each lighting instrument must be unpacked from its protective case before being hung in its proper position on the truss assembly. Additionally, electrical cabling must be connected to the lighting instruments, and then dressed and secured to the truss members. Finally, the completed lighting rig can be hoisted to the required height above the venue floor so that construction of the stage can begin.

Although considerable savings of time and expense would clearly be achieved by transporting the lighting instruments from venue to venue mounted directly on their associated truss section, other problems are encountered using such an arrangement which, if overcome, could lead to significantly increased efficiencies in the transportation and set-up of automated lighting systems.

Specifically, in order to achieve such an advance, the truss sections must adequately protect the mounted luminaires from the damage associated with the shock and vibration experienced during transport. Additionally, the truss sections must provide for two modes of operation: a deployed mode that will expose the luminaires for operation during a performance and a transport mode that will shield and protect the luminaires. In the deployed mode, the truss section must provide each luminaire with enough clearance to allow unobstructed pan and tilt of the luminaires' moving lamp head assemblies. Furthermore, in the deployed mode the truss members should allow the luminaires to be sufficiently lowered to hang below the truss sections such that the light beams are not blocked at certain angles. In the transport mode, on the other hand, the truss section must provide the necessary protection to prevent damage to the luminaire.

"Pre-hung" truss sections have been used before in association with conventional luminaires, utilizing a sliding bar for mounting the conventional luminaire. In such a system, the truss modules are assembled in the required configuration and raised off the floor. Thereafter, a stage hand releases a manual catch which secures the mounting bar and lowers the bar to its fully deployed position where the bar rests upon stops. The lighting rig may then be raised to the required operating height. Following a performance, the rig is lowered to a working height (about four feet above the floor) and the stage hands manually raise the mounting bars until the catches engage, thereby securing the bar and the lighting instruments attached thereto inside the truss sections for transport. The absence of more sensitive optical components in these conventional luminaires has allowed these pre-hung trusses to be constructed without special attachments to secure the lighting instruments in the truss.

Automated luminaires, such as the Vari-Lite models mentioned above, however, require special protection to hold the head and yoke assemblies in a fixed relation to their upper enclosures, since a severe movement of the head and yoke with respect to the upper enclosure during transportation could cause the yoke to break. A truss unit for mounting automated luminaires is disclosed in U.S. Pat. No. 4,862,336 to Richardson et al. The disclosed "dimorphic truss unit" includes hinged side frames which can be folded up to a first position for operation of the stage lights mounted to the truss unit. The side frames can be folded down to a second position around the stage lights for protection during transportation and storage. The disclosed truss unit, however, does not include any shock mount or vibration isolation devices that would serve to protect the stage lights from damage due to vibration, nor does it include any support means for the yoke and lamp head assemblies of the stage lights installed therein. Nor does the truss unit include an automated dual axis deployment mechanism which can deploy luminaires from a stored, shipping position to a deployed, operating position.

Accordingly, it is an object of the present invention to provide a support system for lighting instruments that provides protection for the lighting instruments while traveling between performance venues and provides a motorized mechanism for deploying the lighting instruments to a plurality of different operating positions after the truss sections are assembled and hoisted.

It is a further object of the invention to provide a support system that eliminates the requirement for separate shipping cases having cushioning material for automated luminaires, in addition to eliminating the steps of unpacking and hanging the lighting instruments before each performance.

SUMMARY OF THE INVENTION

A system for supporting a plurality of multiple parameter lighting units in accordance with the invention includes a truss and a lamp mounting platform mounted within the truss. A plurality of lighting instruments are coupled to the mounting platform. A first drive assembly is coupled to the mounting platform to move the lighting instruments between a stored position inside the truss and a deployed position external to the truss. A second drive assembly is coupled to the mounting platform to separate a group of the lighting instruments from another group of the lighting instruments.

BRIEF DESCRIPTION OF THE DRAWINGS

A more complete understanding of the present invention may be had by reference to the following Detailed Description with the accompanying drawings, wherein.

DETAILED DESCRIPTION OF PREFERRED EMBODIMENTS

Figure 1:
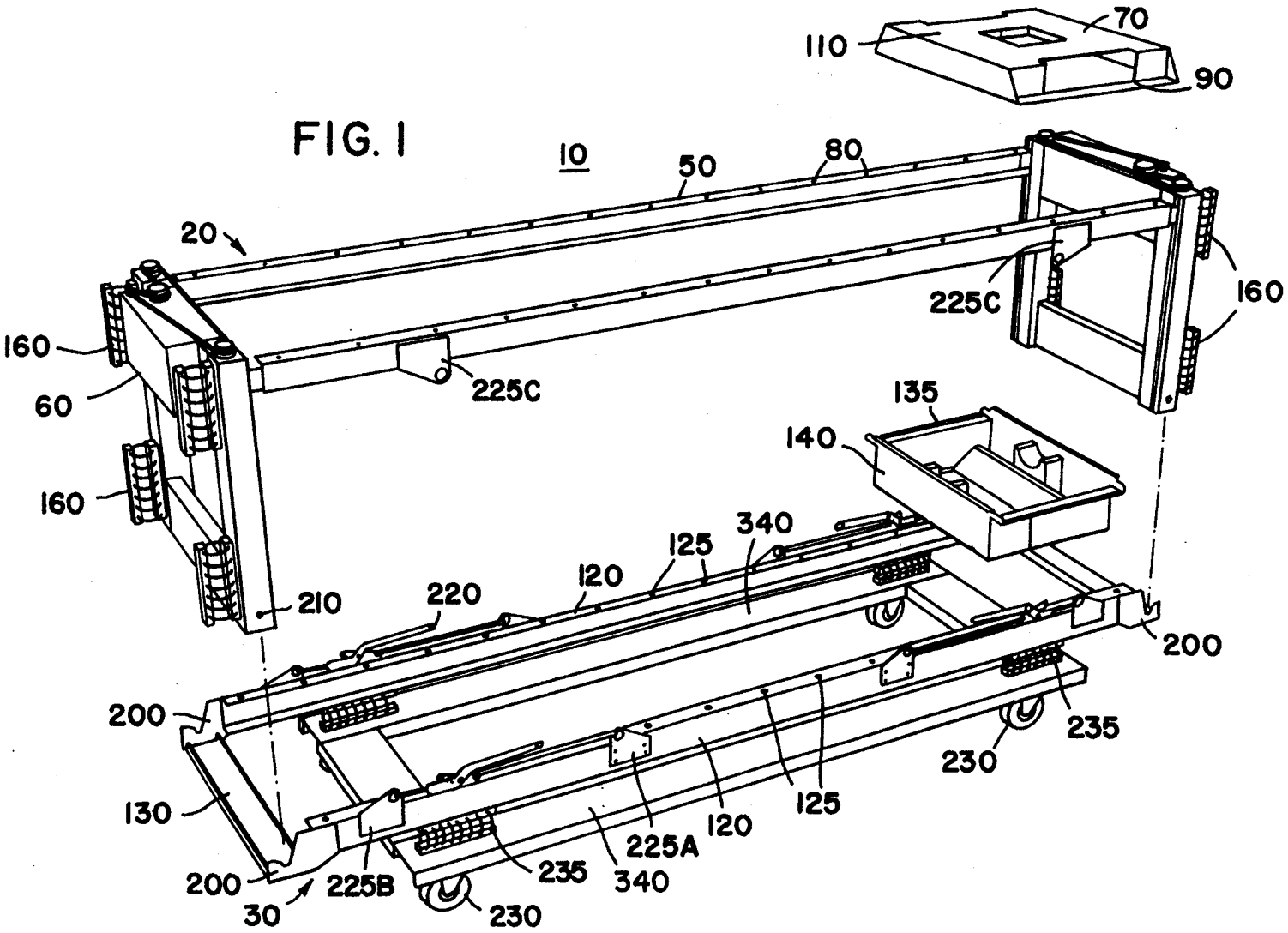
FIG. 1 is a perspective view of a support system according to the present invention.
Figure 2:
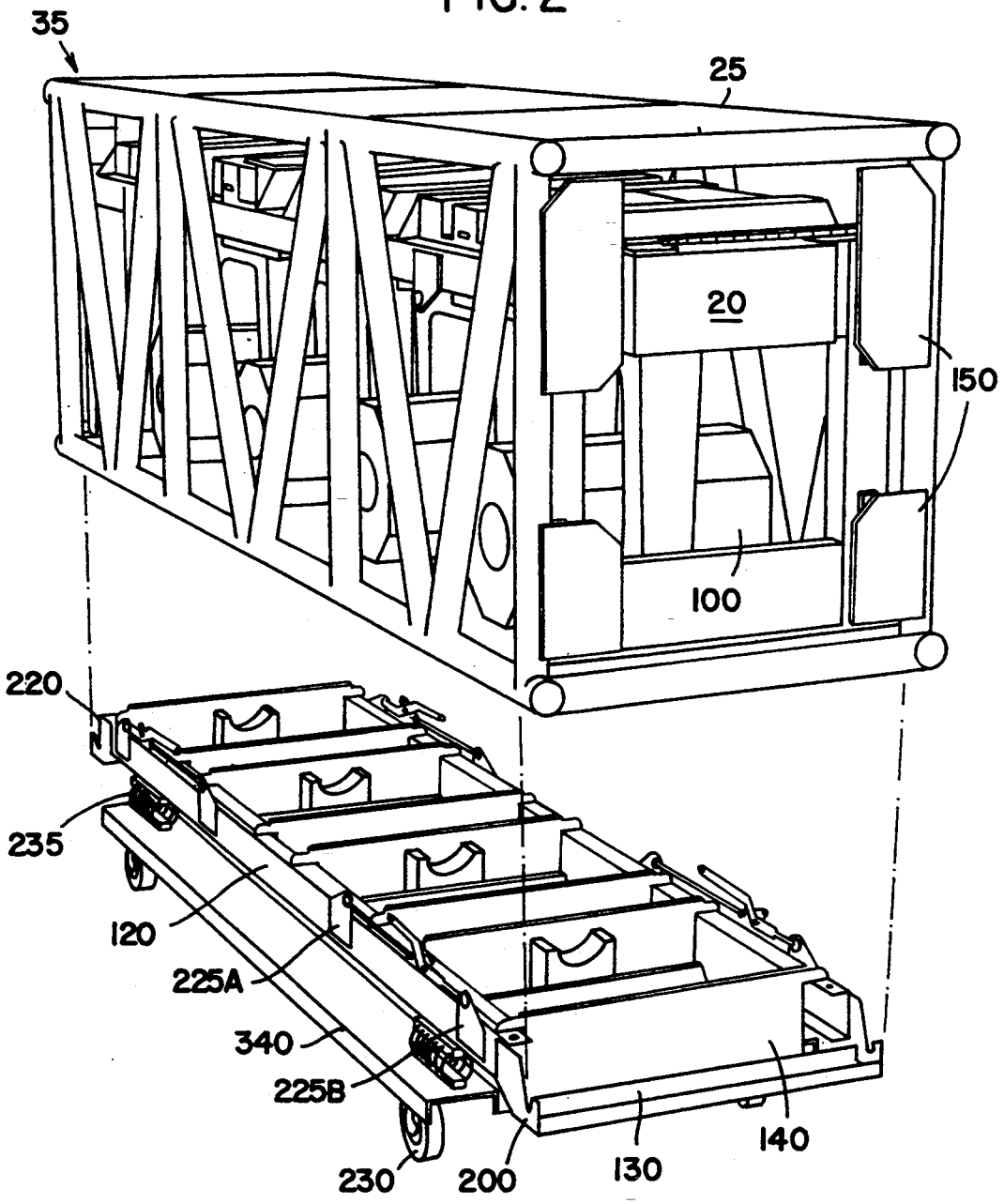
FIG. 2 is a perspective view of a support system according to the present invention having luminaires installed and mounted within a box truss.

The automated truss module 10 of the present invention, shown in FIG. 1, is comprised of an upper luminaire mounting platform 20 and a separable transport support fixture 30. As shown in FIG. 2 and discussed more fully below, a truss section assembly 35, comprised of the upper luminaire mounting platform 20 secured to a known section of box truss 25, is typically suspended from the ceiling of a performance venue with the luminaires 100 mounted to the upper luminaire mounting platform 20.

The automated truss module 10 provides for two modes of operation. In the deployed mode, shown in FIG. 3, the truss section assembly 35 is separated from the transport support fixture 30, allowing the luminaires 100 mounted to the upper mounting platform 20 of the truss section assembly 35 to extend below the truss section assembly 35 for operation. In the transport mode, shown in FIG. 4 (shown for illustrative purposes without box truss 25) and FIG. 5 (shown for illustrative purposes without installed luminaires 100), the luminaires 100 are stored within the truss section assembly 35, and the transport support fixture 30 is fastened to the upper mounting platform 20 of the truss section assembly 35 to secure the luminaires 100 for transport or storage.

The upper mounting platform 20, shown in FIG. 1 (where the box truss 25 has been removed for illustrative purposes), comprises two parallel mounting rails 50 connected at each end to a primary deployment mechanism, such as drive assemblies 60. As will be described in further detail below, the drive assemblies 60 are operable to raise or lower the mounting rails 50.

In a preferred embodiment, an automated luminaire 100 (FIG. 3) can be mounted to the upper mounting platform 20 by means of a lamp support, such as luminaire mounting adaptor pan 70, fastened to the mounting rails 50, as shown in FIG. 1. The adaptor pan 70 may be fastened to the mounting rails 50 by providing a plurality of mounting holes 80 in the mounting rails 50 for alignment with corresponding mounting holes 90 provided in adaptor pans 70. Preferably, the adaptor pans 70 are interchangeable on mounting rails 50 to accommodate various types of luminaires 100. Accordingly, adaptor pans 70 can be specifically designed for mating with specific luminaires 100 by constructing each adaptor pan 70 with mounting holes 110 arranged in a pattern which matches the corresponding pattern of mounting holes in the luminaire 100 for which the adaptor pan 70 is designed.

As mentioned above, the upper mounting platform 20 of the automated truss module 10 is mounted to a section of box truss 25 to form a truss section assembly 35, shown in FIG. 2. While the section of box truss 25 may be fabricated in accordance with standard construction principles, the bottom of the box truss 25 must remain clear of cross members, except at its ends, as shown in FIG. 6C, so that the luminaires 100 will not be obstructed as they are raised or lowered on the mounting rails 50. In addition, the box truss 25 is preferably constructed with mounting or gusset plates 150 (FIGS. 2 and 5) welded to each corner of the box truss 25.

Helical isolators 160 are preferably mounted on the corners of drive assemblies 60, as shown in FIGS. I and 4, for mounting the upper mounting platform 20 to the mounting plates 150 of the box truss 25. A helical isolator, formed by winding the length of a steel wire rope into a helix before clamping the loops of the wound wire rope between two metal mounting plates, provides a sturdy cushion against shock, and limits the transfer of vibration between the upper mounting platform 20 and the box truss 25.

In a preferred embodiment, the drive assemblies 60 of the upper mounting platform 20, used for raising or lowering the mounting rails 50, are motorized. In this embodiment, the upper mounting platform 20 consists of a motorized drive assembly 60 at each end to connect the two parallel mounting rails 50. Each motorized drive assembly 60 includes a single reversible electric motor 170 (FIG. 5) and a drive arrangement, as is known in the art, consisting of a drive belt or chain 180, plus the necessary pulleys and gears. In addition, two linear ball screws enclosed within each drive assembly 60 are connected to the drive arrangement such that the single motor 170 of the drive assembly 60 drives both ball screws. The mounting rails 50 are connected to the two ball screws such that rotation of the ball screws raises or lowers the parallel mounting rails 50.

In this manner, the two drive assemblies 60 and the two mounting rails 50 form a motorized unit which can raise or lower the mounting rails 50. The motors 170 within each of the drive assemblies 60 are preferably wired together to operate at the same time to raise or lower mounting rails 50 in synchronism. A control circuit in the motorized drive assembly 60 includes relays and limit switches, interconnected in a fashion well known in the art, to prevent over driving the mechanism in either direction, by de-energizing the motors when mounting rails 50 are fully deployed (down) or fully retracted (up). Alternatively, a microprocessor-based control circuit can be used to accept control signal inputs, monitor the state of limit switches, and through appropriate interface circuits, energize and de-energize the motors as required. A truss unit identity switch, comprising a two- or three-digit thumbwheel switch, may also be included in the control circuit to identify a particular truss unit in a computer controlled system.

Electrical connectors are provided on each motorized drive assembly 60 to permit coupling to an electric power source. In addition, electrical connectors are preferably provided to permit coupling to a hand-held control box containing UP and DOWN switches, and to permit electrical coupling of one support system module to another in a daisy-chain fashion; thereby allowing a stage hand operator to use one control box to lower or raise plural support system modules at the same time.

In an alternative embodiment, the upper luminaire mounting platform 20 can be arranged in such a manner as to allow the mounted luminaires 100 to spread apart as they are lowered from the storage position to the deployed position. In this manner, storage space is optimized by storing the luminaires in a compact position within the truss section assembly 35 for transport, while providing sufficient clearance in the deployed mode to permit the luminaires 100 to pan and tilt during operation without contact with an adjacent luminaire 100. This embodiment is discussed in further detail below in connection with FIGS. 8–15.

Figure 4:
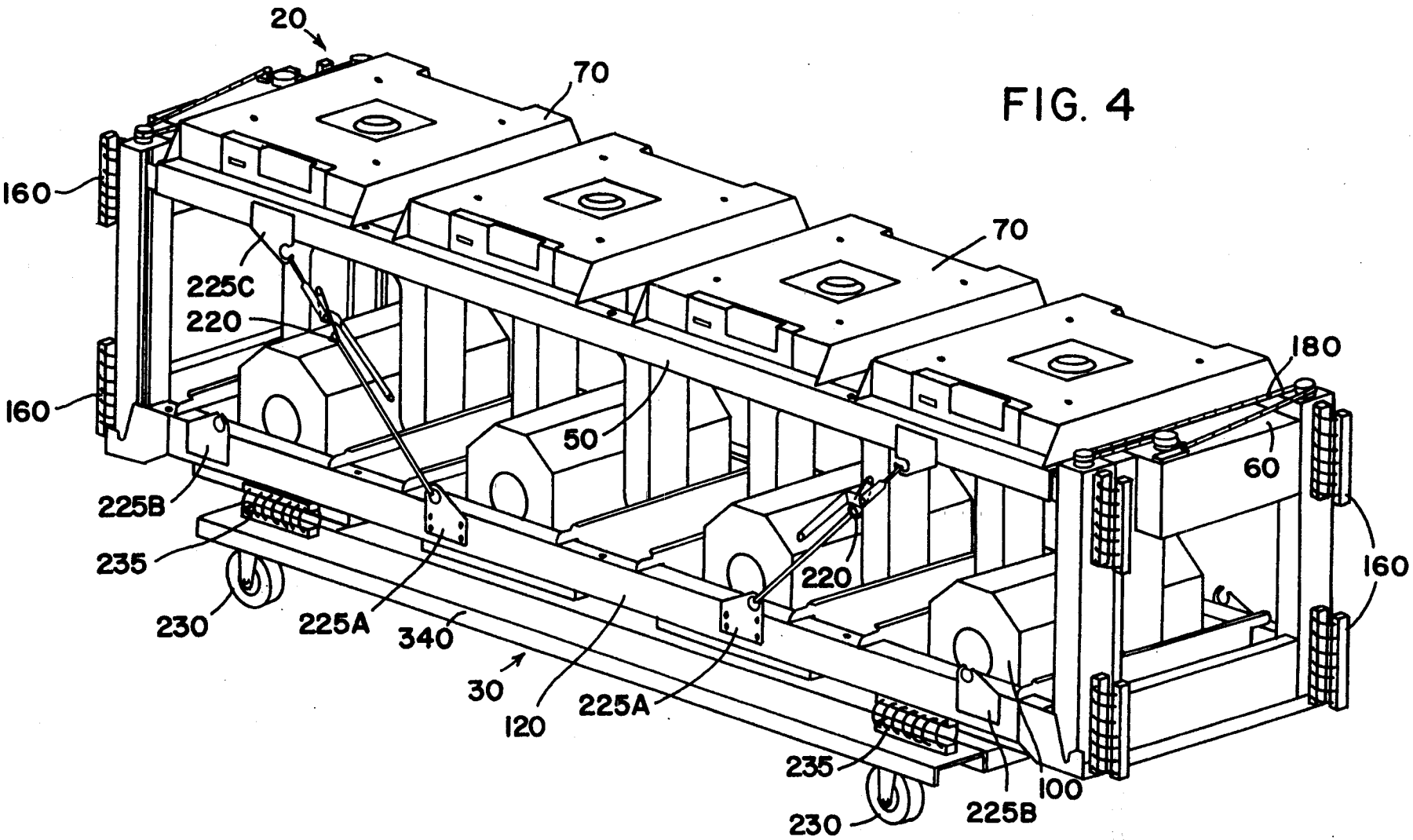
FIG. 4 is a perspective view of a support system assembled with automated luminaires installed.
Figure 5:
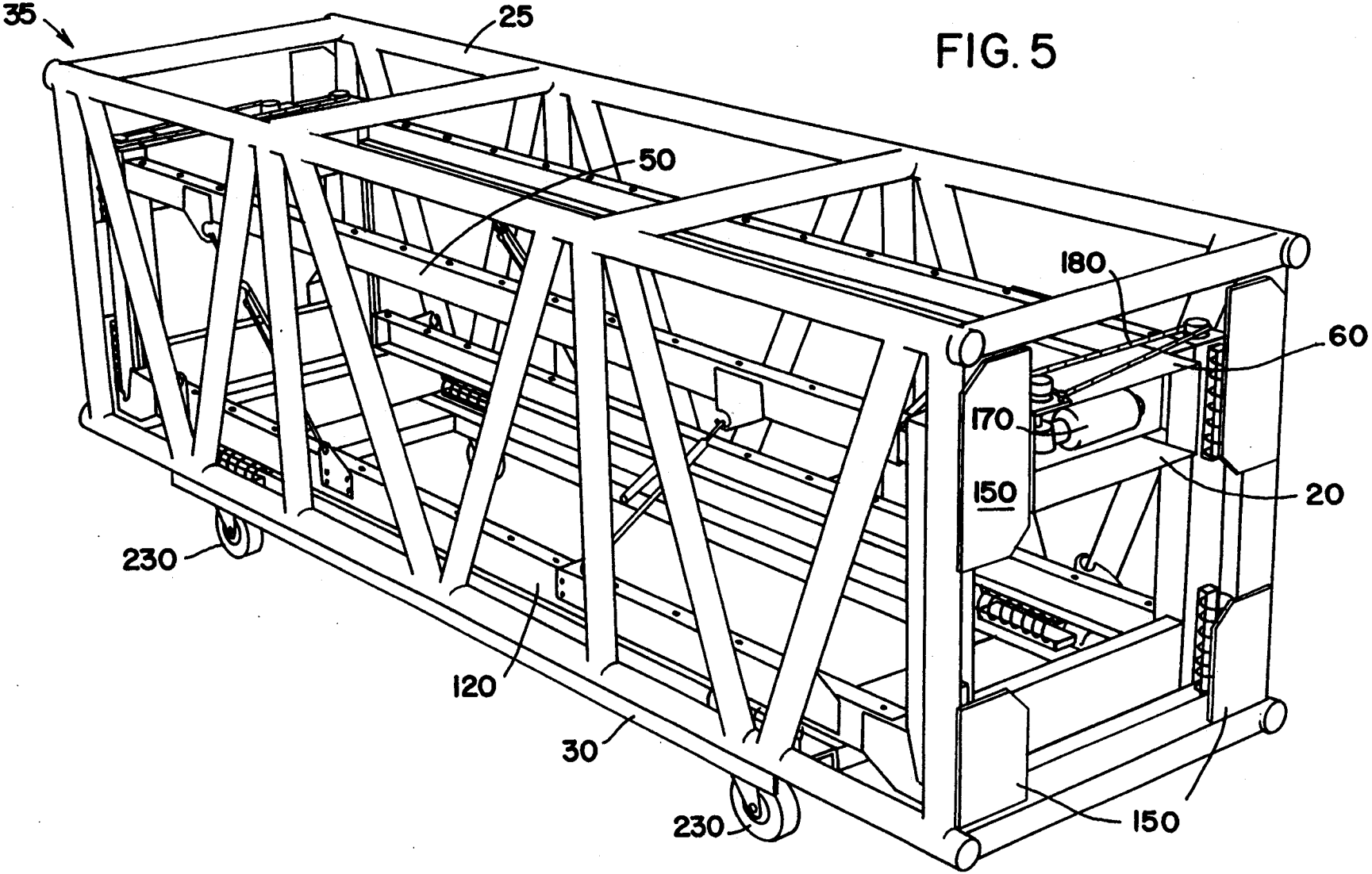
FIG. 5 is a perspective view of a support system mounted within a box truss.

To secure the luminaires 100 for transit within the truss module 10, the transport support fixture 30 is fastened to the bottom of the upper mounting platform 20 after retracting the luminaires 100 into the truss section assembly 35, as shown in FIGS. 4 and 5. The transport support fixture 30, shown most clearly in FIG. 1, comprises two parallel fixed mounting rails 120, connected at each end by end rails 130. Preferably, the transport support fixture 30 includes luminaire head cradles 140, fastened to the fixed mounting rails 120 by means of mounting holes 125 in the mounting rails 120 for alignment with corresponding mounting holes 135 in head cradles 140, for securing a luminaire 100 during transport.

In a preferred embodiment, a variety of head cradles 140 are interchangeable on mounting rails 120 to accommodate various types of luminaires 100. Accordingly, head cradles 140 can be specifically designed for mating with specific luminaires 100 by constructing each head cradle 140 with an interior shape that matches the external profile of the luminaire 100 for which the head cradle 140 is designed. The head cradles 140, which secure the head assembly of the lighting instruments and prevent excessive movement during transportation of the truss module, serve to limit destructive motion of the head and yoke of the luminaire 100 with respect to the upper chassis enclosure of the luminaire 100.

In order to facilitate the alignment of transport support fixture 30 with the upper mounting platform 20 during fastening, notches 200 are provided in the end rails 130. The notches 200 mate with alignment pins 210 installed in the bottom of drive assemblies 60, thereby maintaining proper alignment of the transport support fixture 30 with upper mounting platform 20.

To secure the transport support fixture 30 to the truss section assembly 35, latches 220 are provided at each of the four corners of the transport support fixture 30. When the transport support fixture 30 is separated from the truss section assembly 35 for storage during a performance, the latches 220 are placed in their storage positions, i.e., coupled to hooks 225A and 225B, as shown in FIG. 1. When the transport support fixture 30 is to be secured to truss section assembly 35 for transport and storage, the latches 220 are placed in their fastened position, i.e., coupled to hooks 225A and 225C, as shown in FIG. 4.

As shown in FIG. 5, casters 230 can be provided on the bottom of the transport support fixture 30 to facilitate movement of the assembly, which can weigh up to 400 pounds when mounted with four large luminaires 100. In the preferred embodiment, the two parallel fixed mounting rails 120 of the transport support fixture 30 are secured by means of four helical isolators 235 to the two parallel base rails 240 riding upon casters 230, as shown in FIGS. 1 and 4. As noted above, the helical isolators 235 provide a sturdy cushion against shock, and limit the transfer of vibration.

In preparation for a stage show or other performance event, the truss section assembly 35 containing automated luminaires 100 mounted in upper mounting platform 20 is attached to support cables (not shown) in a manner well known in the entertainment lighting industry. Latches 220 are released from hooks 225C and coupled to hooks 225B, to place the latches 220 in their storage position, as described above. Since the transport support fixture 30 is no longer fastened to the truss section assembly 35, the truss section assembly 35 can be raised, leaving the transport support fixture 30 on the venue floor as shown in FIG. 2.

Figure 3:
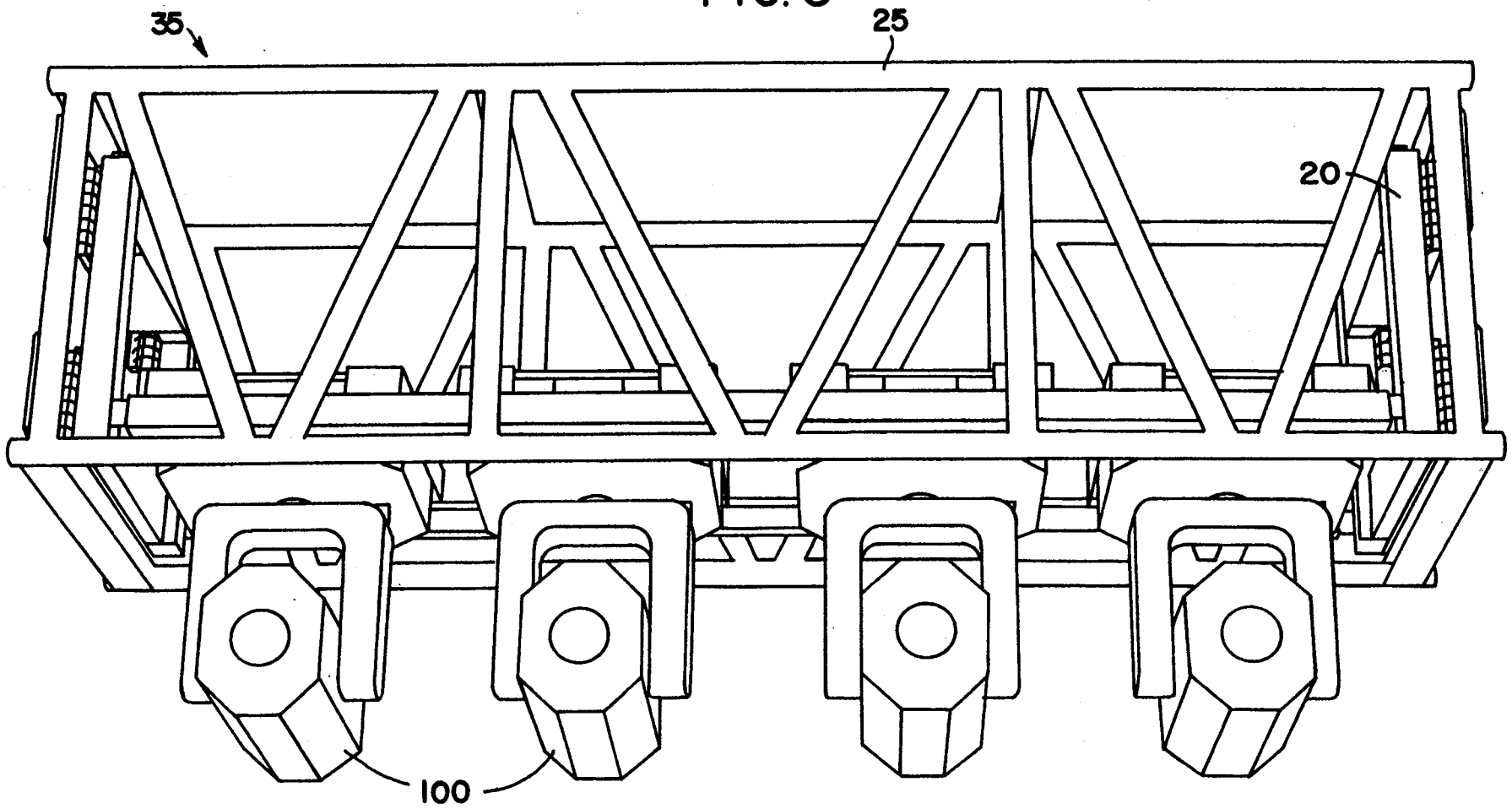
FIG. 3 is a perspective view of a support system mounted within a box truss, showing installed luminaires deployed in an operating position.

Once a stage hand operator has connected the various electrical cables to the luminaires 100, and to the support system drive assemblies 60, including the control box (not shown), the operator may press the DOWN button to deploy the luminaires 100 as shown in FIG. 3. When the luminaires are fully deployed, the control box (not shown) can be disconnected or stored in the truss section assembly 35, and the truss section assembly 35 can be raised to the desired height above the stage.

The truss section assembly 35 can also be used in an inverted position so that the drive assemblies 60 raise the luminaires 100 up out of the truss section assembly 35 for use and retract the luminaires 100 into the truss section assembly 35 for storage. Alternatively, the truss section assembly 35 can be used vertically so that the drive assemblies 60 extend the luminaires 100 sideways out of the truss section assembly 35.

Figure 7:
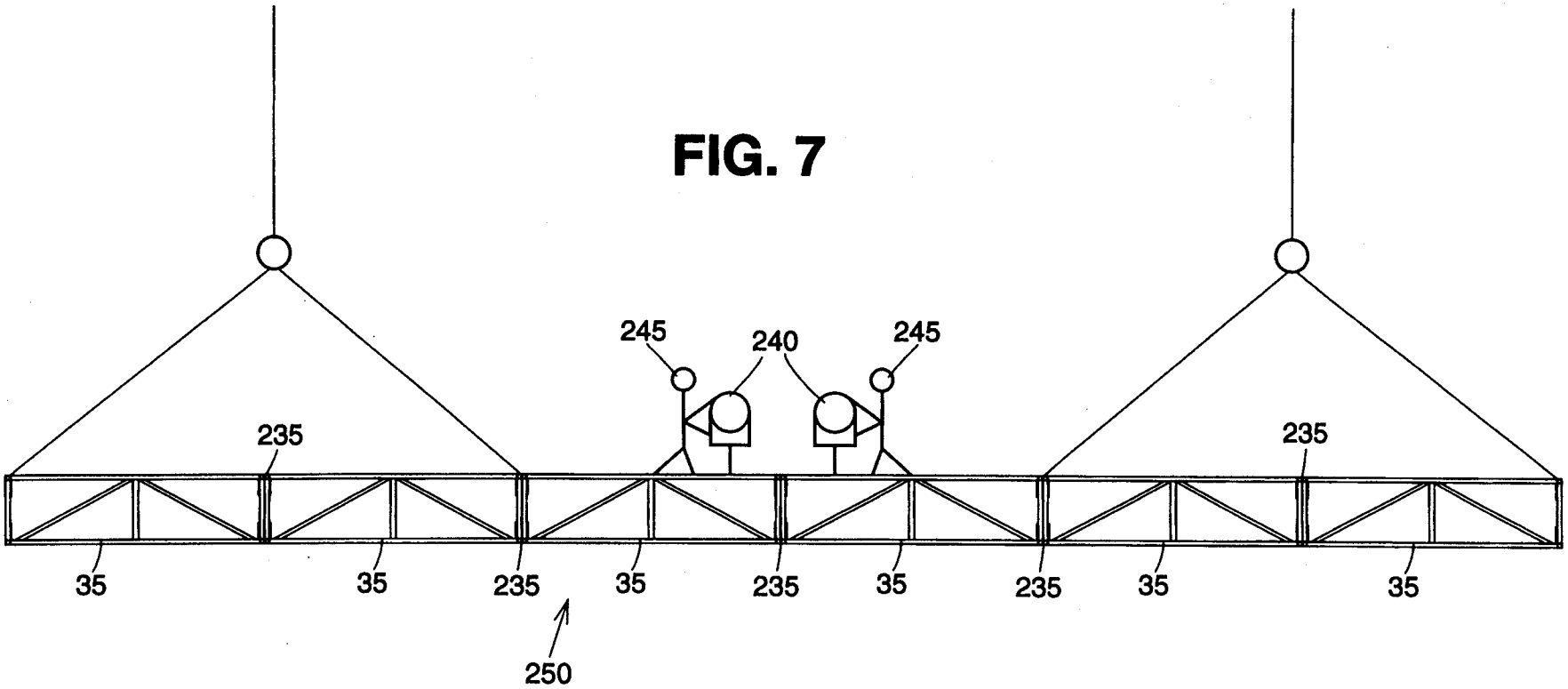
FIG. 7 is a front view of a truss structure comprised of six truss section assemblies coupled end-to-end.

As is known in the art, the truss section assembly 35 can include coupling provisions 235 at each end so that sections of box truss 25 can be fastened together end-to-end. In this manner, an entire truss structure 250 can be constructed, as shown in FIG. 7. In a typical configuration, 6 truss section assemblies 35, each having a length of about 105 inches, are coupled together end-to-end by providing nesting truss members at each end that can be interlocked with an adjacent truss section assembly 35 by inserting a pin through the nested ends to construct a truss structure approximately 52 feet long. For a truss section assembly 35 having a length of 105 inches, four large automated luminaires 100, five medium-sized automated lighting instruments, ten small instruments, or a mixture thereof can be mounted. In addition, a number of instruments arranged in rows running along the length of the truss section can be employed.

Figure 6A:
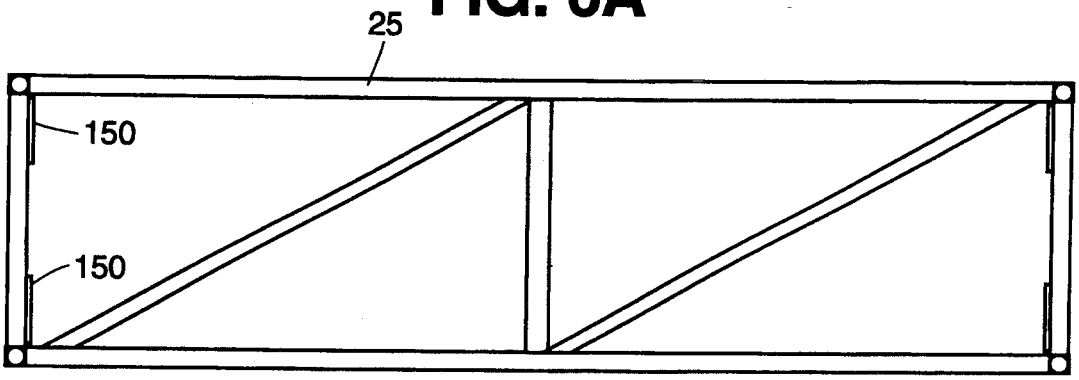
FIGS. 6A, 6B and 6C are top, side and bottom views, respectively, of a box truss.
Figure 6B:
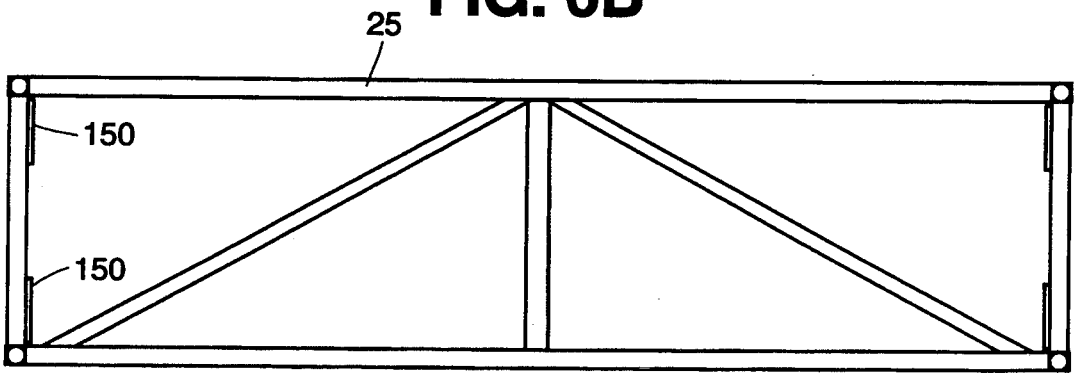
Figure 6C:
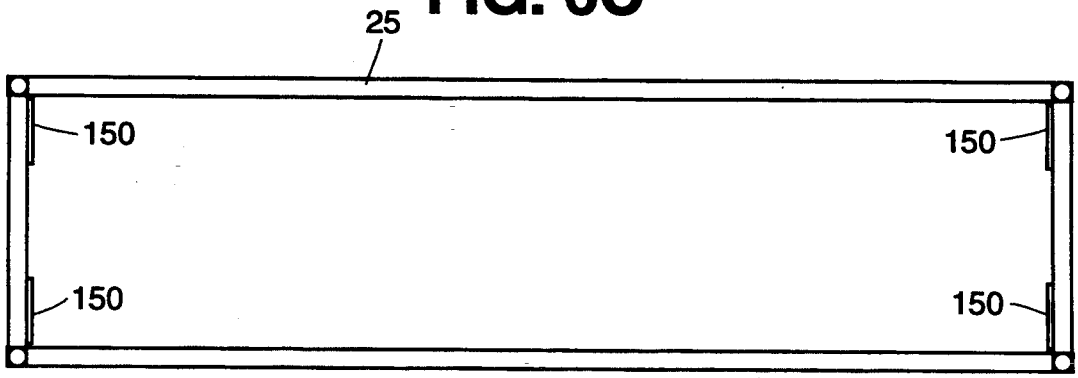

In a preferred embodiment, when the upper mounting platform 20 of the automated truss module 10 is mounted to a section of box truss 25, constructed of cord tubing having a diameter of not more than 2 inches and having the configuration shown in FIGS. 6A (top view), 6B (right and left side views) and 6C (bottom view), the resulting truss section assembly 35 weighs approximately 150 pounds, including the weight of the upper mounting platform 20. If a maximum equipment load of 400 pounds per truss section assembly 35 is specified, each truss section assembly 35 must support a maximum total weight of 525 pounds.

As shown in FIG. 7, it is often desirable to position spot lights 240 and spot light operators 245 on the top of the truss structure 250 during a performance. A pair of spot light operators 245 (200 pounds each) and their corresponding spot light equipment 240 (200 pounds each) result in an added load of 800 pounds. Accordingly, a truss structure 250 comprised of six truss section assemblies 35 and a pair of spot light operators 245 and their corresponding spot light equipment 240, must support a total load of 3950 pounds.

Figure 8:
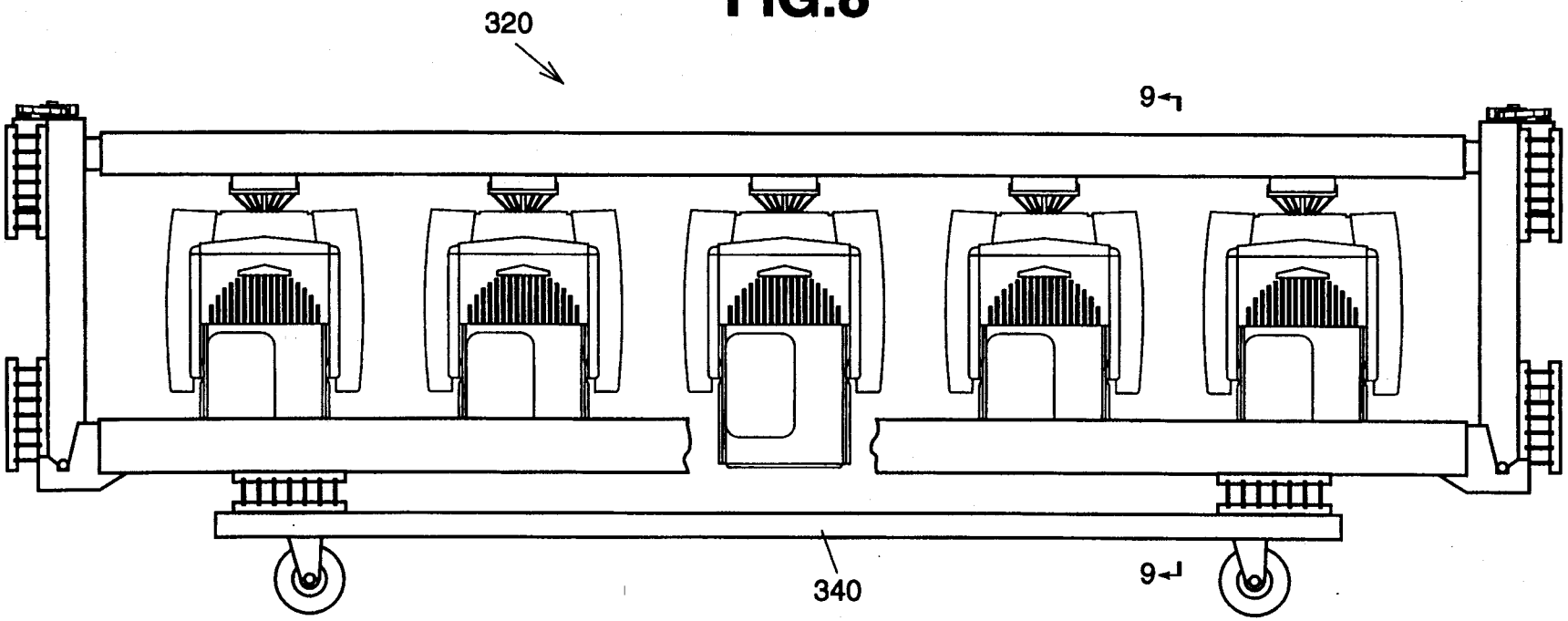
FIG. 8 is a view of another support system assembled with automated luminaires installed.
Figure 9:
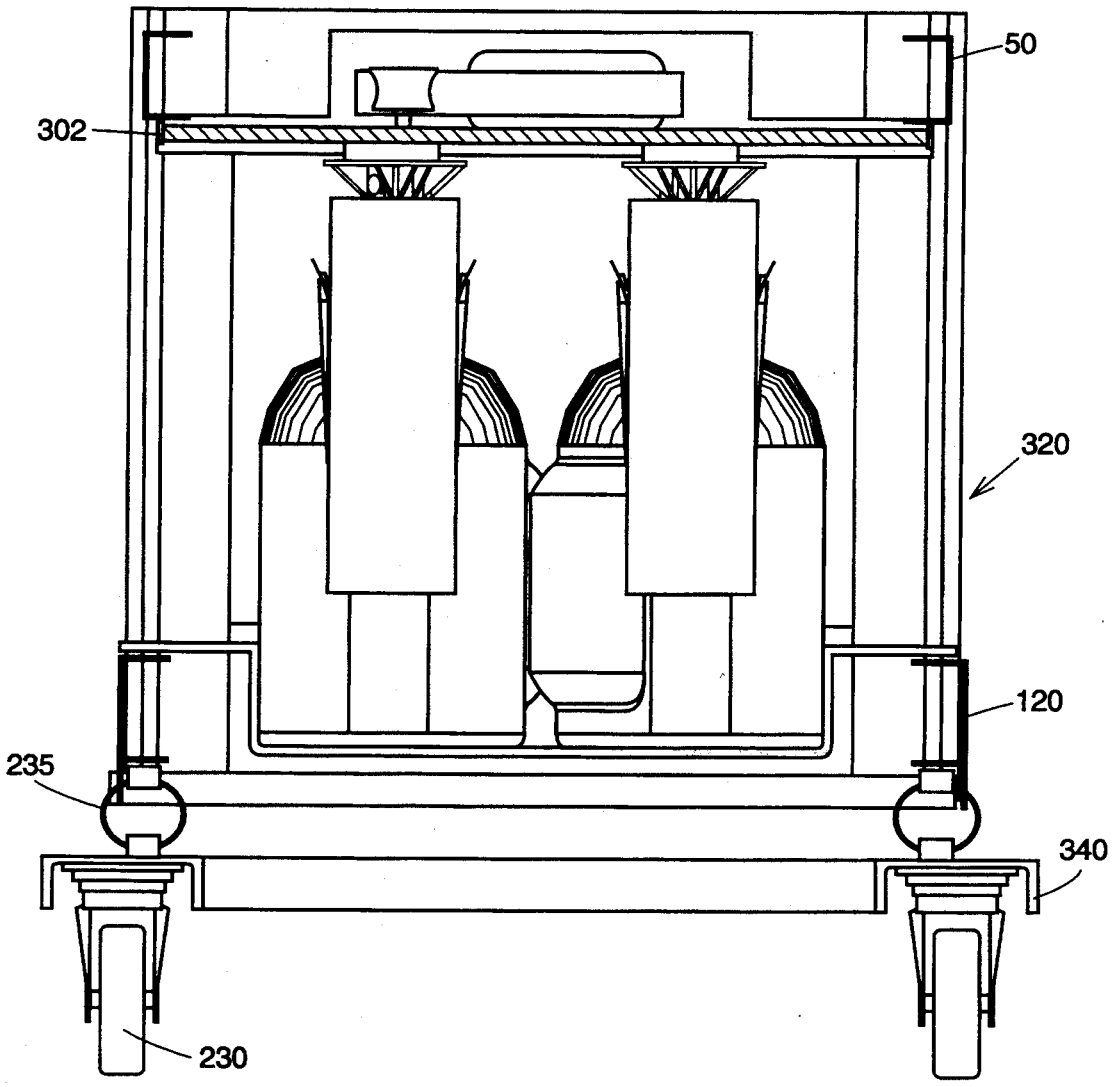
FIG. 9 is a cross-sectional view of the support system of FIG. 8.
Figure 10:
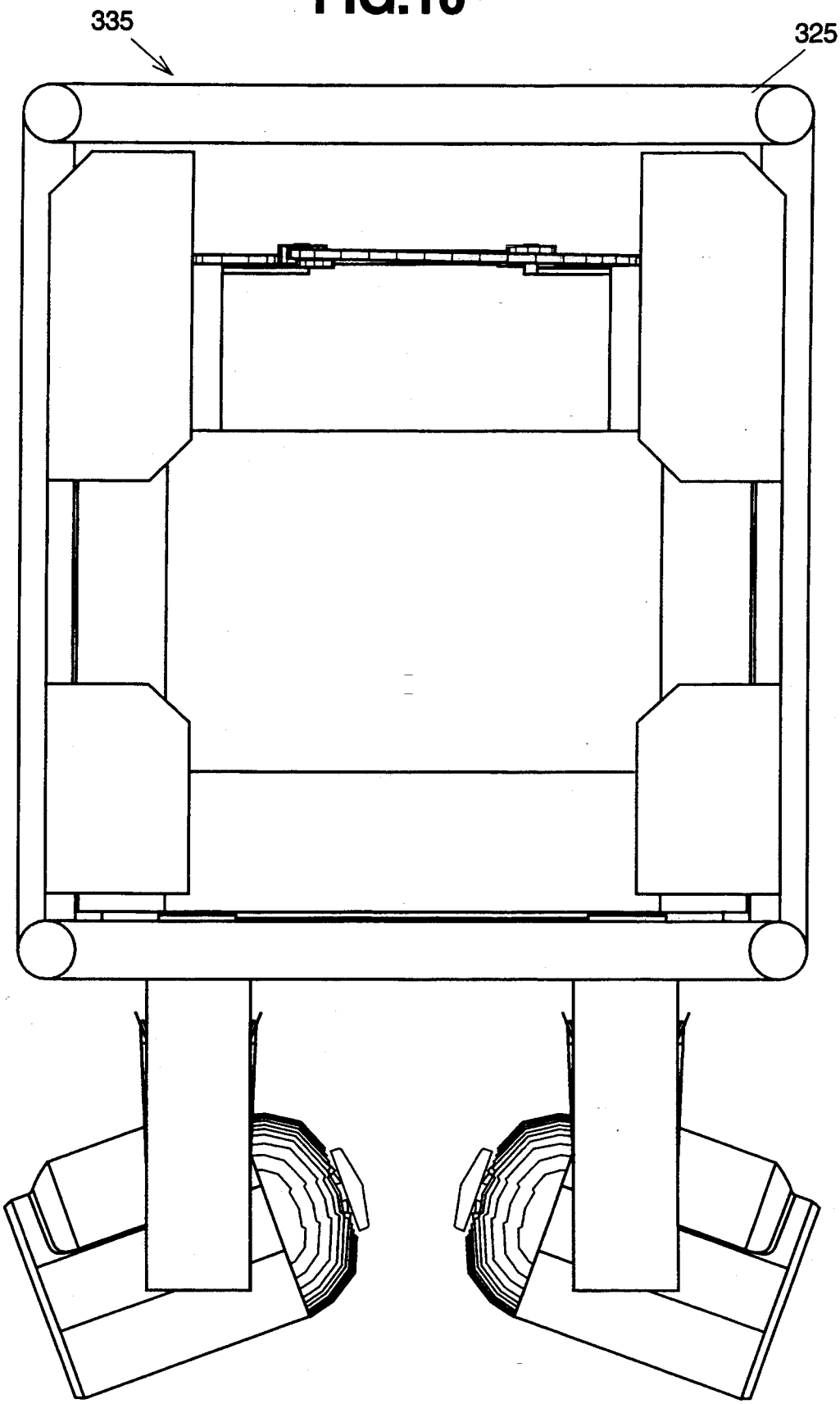
FIG. 10 is a view of the support system of FIG. 8 mounted within a box truss, showing the installed luminaires deployed in an operating position.

In a further embodiment of the invention, as shown in FIG. 8, the truss section assembly can be loaded with two rows of a plurality of automated luminaires each. In the embodiment of FIG. 8, two rows of five luminaires each are loaded. Although the support system shown in FIG. 8 possesses sufficient internal space to accommodate the ten luminaires in a protected position (inside the truss section), the luminaires may, depending on their size, be too closely spaced to allow unimpeded pan and/or tilt motion of their respective system yokes and lamp head assemblies when lowered to a deployed position (outside the truss section). The inability to freely pan arises if the shoulder-to-shoulder spacing of the luminaires along the length of the support system is insufficient to allow pan movement without interference from adjacent luminaires in the same row (longitudinally with respect to the support system). In addition, insufficient clearance between the luminaires of a row can also impede the ability to pan freely. The inability to tilt freely arises if the clearance between luminaires of adjacent rows (transversely with respect to the support system) is insufficient to allow tilt movement of a luminaire of one row without interference from an adjacent luminaire in the other row.

To obtain sufficient clearance between luminaires of adjacent rows when the support system is in the deployed position, a secondary deployment mechanism is provided to spread the luminaires apart while or after lowering the luminaires to the deployed position, and to draw them together again prior to or while returning the luminaires to the protected position. A control circuit operates the secondary deployment mechanism, and interlock devices such as switches, optical sensors and the like protect the luminaires from damage during positioning between the deployed and stored positions.

Figure 12:
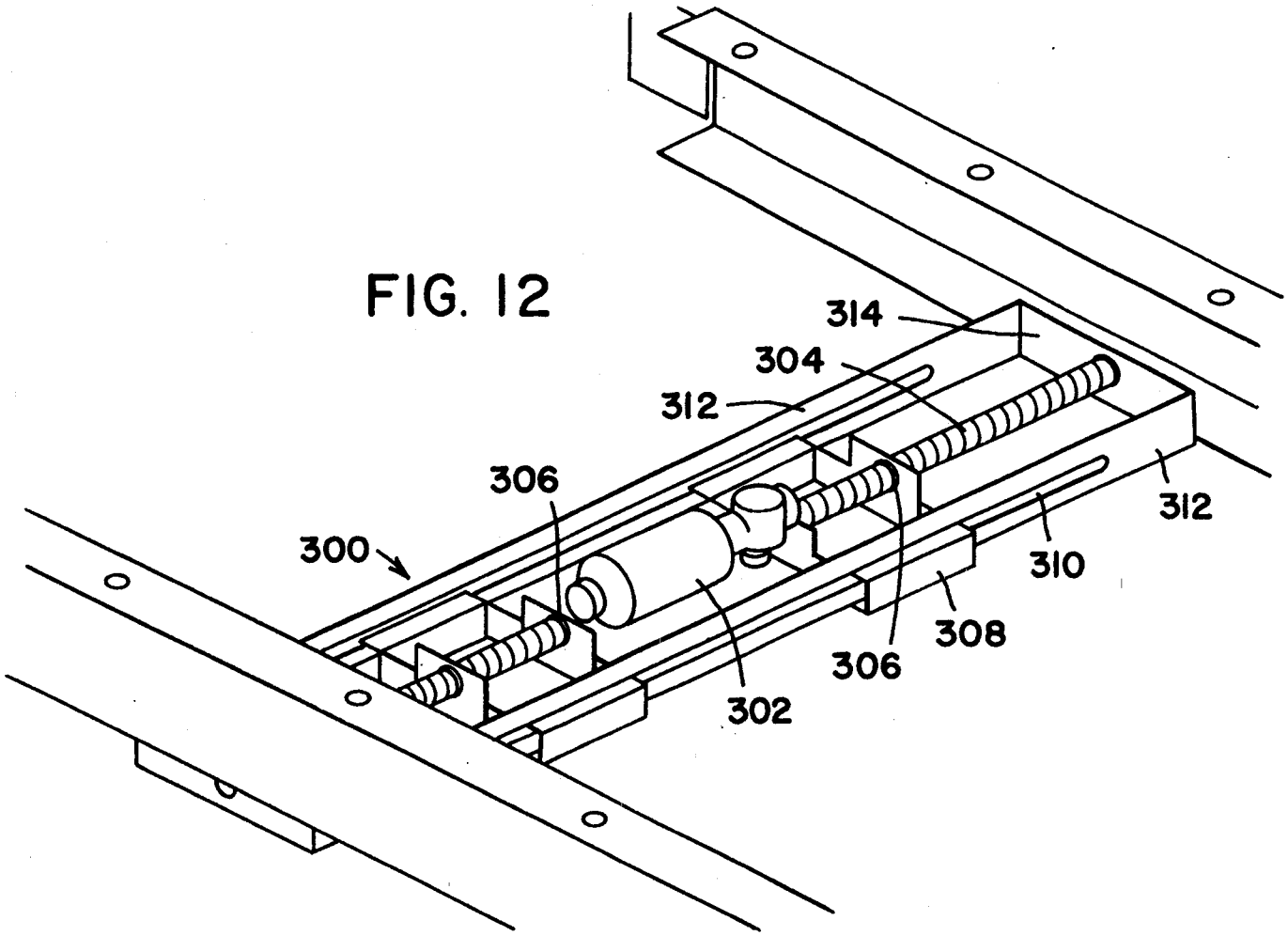
FIG. 12 is a detailed view of a secondary deployment mechanism which forms a part of the support system of FIG. 8.

In one embodiment, shown in FIG. 12, the secondary deployment mechanism 300 includes a reversible electric motor 302 coupled to a translation device, such as a lead screw 304 that passes through threaded ball nuts 306 journaled for rotation within luminaire mounting adaptors 308. The translation device translates motor movement into luminaire motion. Mounting adaptors 308 are specially constructed to secure smaller luminaires to the mounting platform 320. The individual mounting adaptors 308 are slidably mounted within channels 310 formed in rails 312 of support 314. A luminaire can be attached to each individual mounting adaptor, such that the latter acts a lamp support. In operation, as reversible motor 302 runs in one direction, rotation of lead screw 304 within ball nuts 306 forces the mounting adaptors 308 and luminaires mounted thereto apart from each other, while rotation of motor 302 in the opposite direction retracts the mounting adaptors, and hence the attached luminaires, toward each other.

To protect the luminaires from damage as a result of the operation of the secondary deployment mechanism, limit switches, or other suitable sensors (not shown), can be employed to indicate when the luminaires have reached their deployed position. Such switches preferably are installed in a position where movement of the mounting rails 50 to the deployed position operates the switch, or otherwise actuates the sensor, and permits, through the intervening agency of a suitable control circuit, energization of motor 302 to spread the luminaires. A second switch or sensor (not shown), arranged to indicate positioning of the luminaires in the spread position, cooperates with the control circuit to de-energize motor 302.

While it may be prudent to postpone actuation of the secondary deployment mechanism until the primary deployment mechanism has fully deployed, it may be preferable to provide for simultaneous actuation of both the primary and secondary deployment mechanisms, so long as effective interlocks prevent actuation of the secondary mechanism while the luminaires are still within the interior of the support system and, further, prevent actuation of the primary mechanism from withdrawing the support rails to the protected position if the secondary mechanism has not sufficiently retracted the luminaires to clear the truss and module structure. Thus, in an alternative embodiment, when the support rails 50 begin moving toward the deployed position, a sensor (not shown) indicating such movement, and operating through the control circuit, energizes motor 302 in a direction to spread the luminaires, and to retract the luminaires toward each other when moving toward the protected position. In a further alternative embodiment, motor 170, controlling the vertical motion of support rails 50, can be rendered inoperable by deactivation of a sensor indicating that the luminaires have moved from a fully retracted position. When such sensor indicates to the control circuit the condition of full retraction of the pair of luminaires, it permits the support rails to move into the protected position. The control circuitry described is well known in the art, and does not constitute a part of the present invention.

It is to be understood that other suitable actuating means can be employed in place of motor 302. For example, a pneumatic or hydraulic cylinder coupled to individual mounting adapters 308 and operated by a suitably adapted control system can be effectively employed to achieve the effects described above with respect to motor 302.

Figure 11:
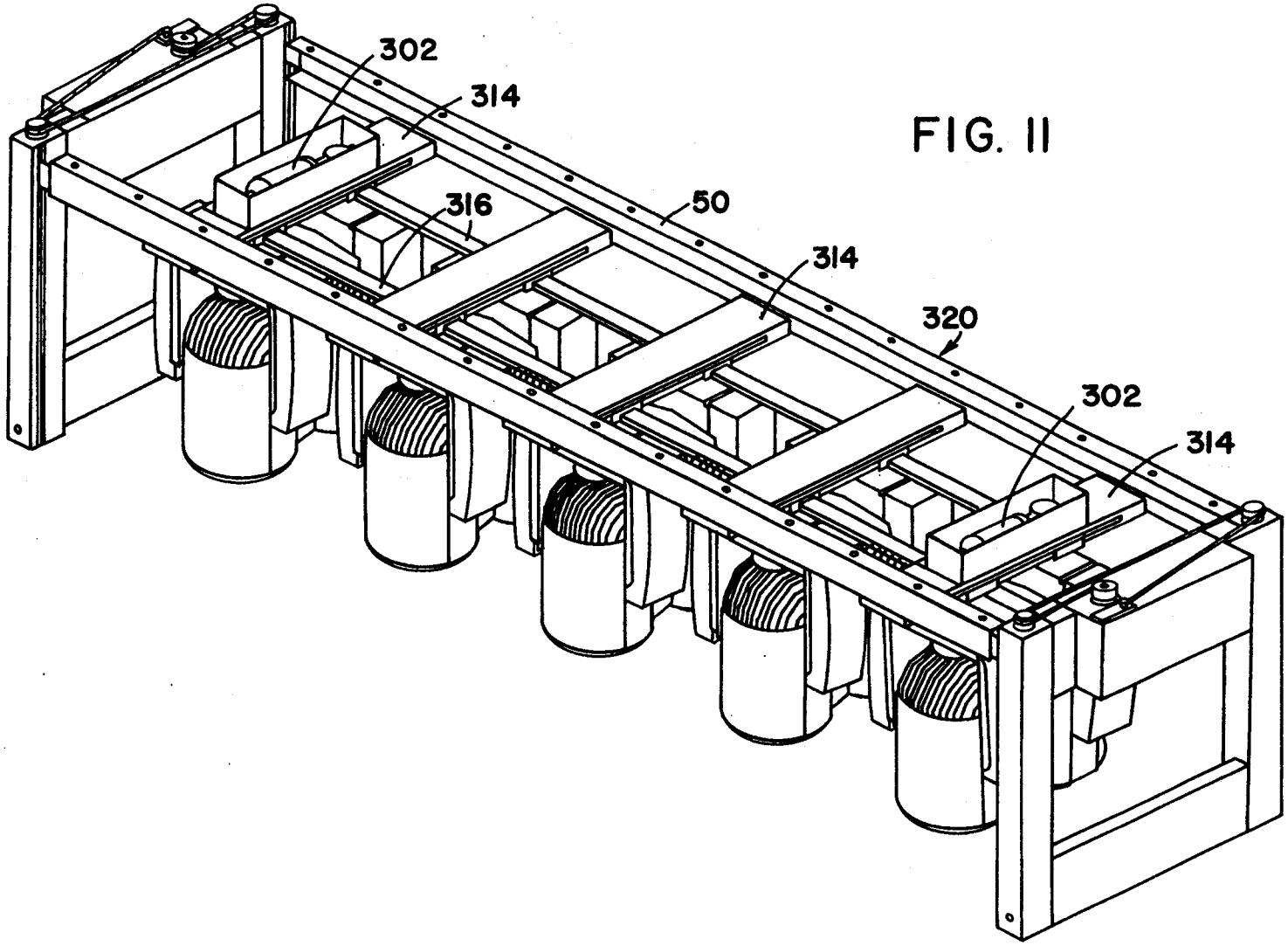
FIG. 11 is a perspective view of the support system of FIG. 8.

As shown in FIG. 11, a pair of motors 302 can be installed on supports 314 at the end of the support system. Motors 302 drive not only the individual mounting adaptors 308 associated with the luminaires directly beneath the respective motors, but can be coupled to each of the luminaires of the row by means of interconnecting members 316. Members 316 join all the individual mounting adapters of a row so that simultaneous operation of motors 302 causes spreading/retracting of all the individual mounting adapters in the row.

In a further alternative embodiment, a motor 302 can be mounted on each support 314, and without interconnecting members 316, such that pairs of luminaires can be operated independently to achieve the same results. By providing individual motors 302 for each pair of luminaires, larger luminaires can be mounted within the same support system module as smaller luminaires.

Figure 16:
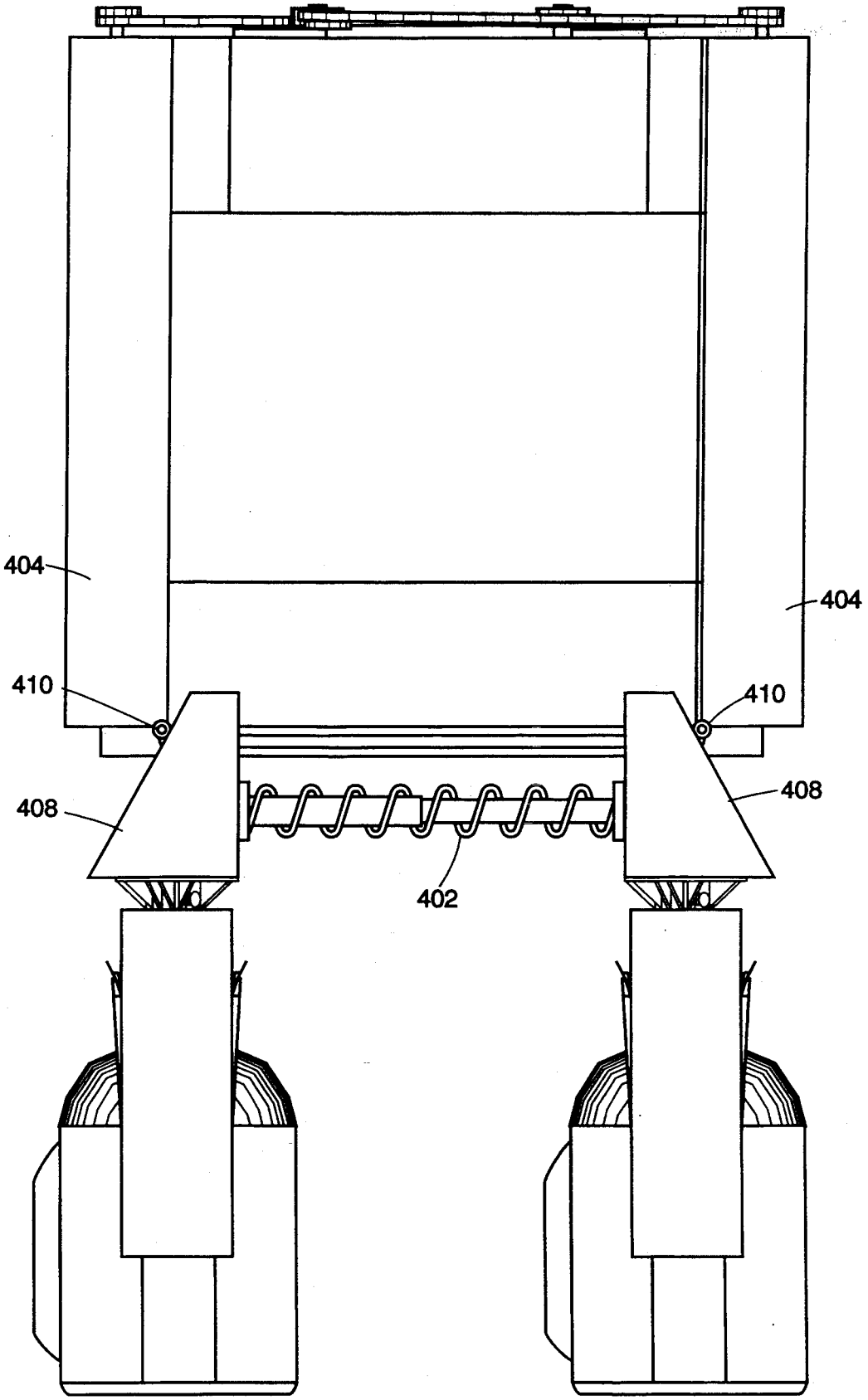
FIG. 16 is a view of another embodiment of the invention.

In another embodiment of the present invention, shown in FIG. 16, a spring actuator 402 can be used to urge the luminaires apart. Such a spring-type actuator preferably includes mounting adaptors 408 adapted to restrain the luminaires from spreading apart while in the protected position, while allowing the luminaires to spread apart while moving to the deployed position. As shown in FIG. 16, the sloped surfaces of mounting adaptors 408 cooperate with rollers 410 so that raising the rails squeezes the luminaires together, overcoming the force applied by the spring actuator 402. The spring actuator 402 can take the form of one or more compression springs or gas-charged cylinders coupled to the slidable mounting adaptors 408, such that the actuator is compressed while the luminaires are moved to the protected position, and extends when the luminaires are moved toward the deployed position. Alternatively, one or more extension springs can be coupled to a scissor-type mechanism such that the spring is extended while the support rails are in the protected position.

The spring actuated secondary deployment mechanism of FIG. 16 provides an additional benefit of eliminating the need for an active interlock control system, since the operation of the primary deployment mechanism enables the secondary deployment mechanism.

Figure 13:
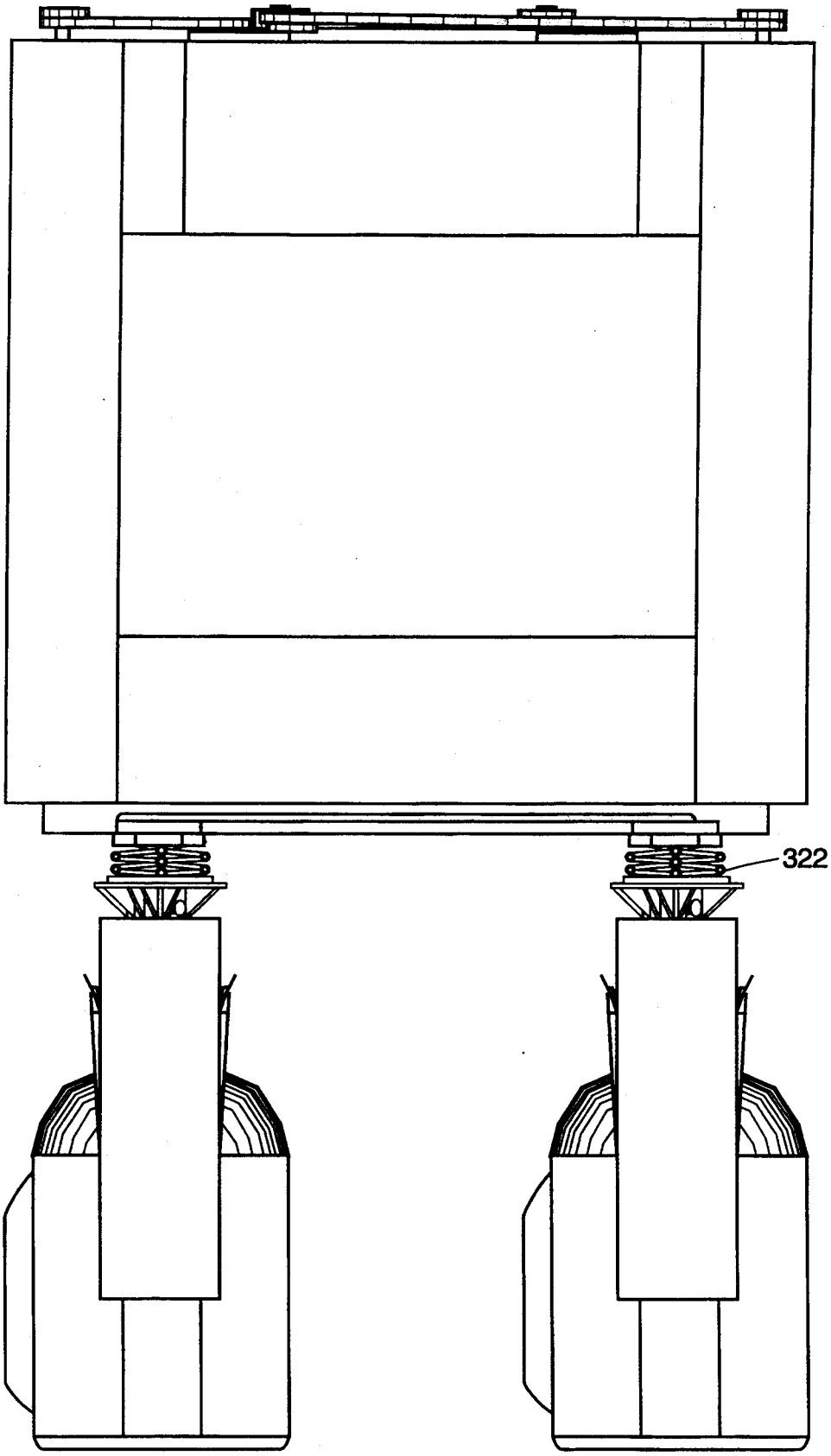
FIG. 13 is an end view of another embodiment of the support system of the present invention.
Figure 14:
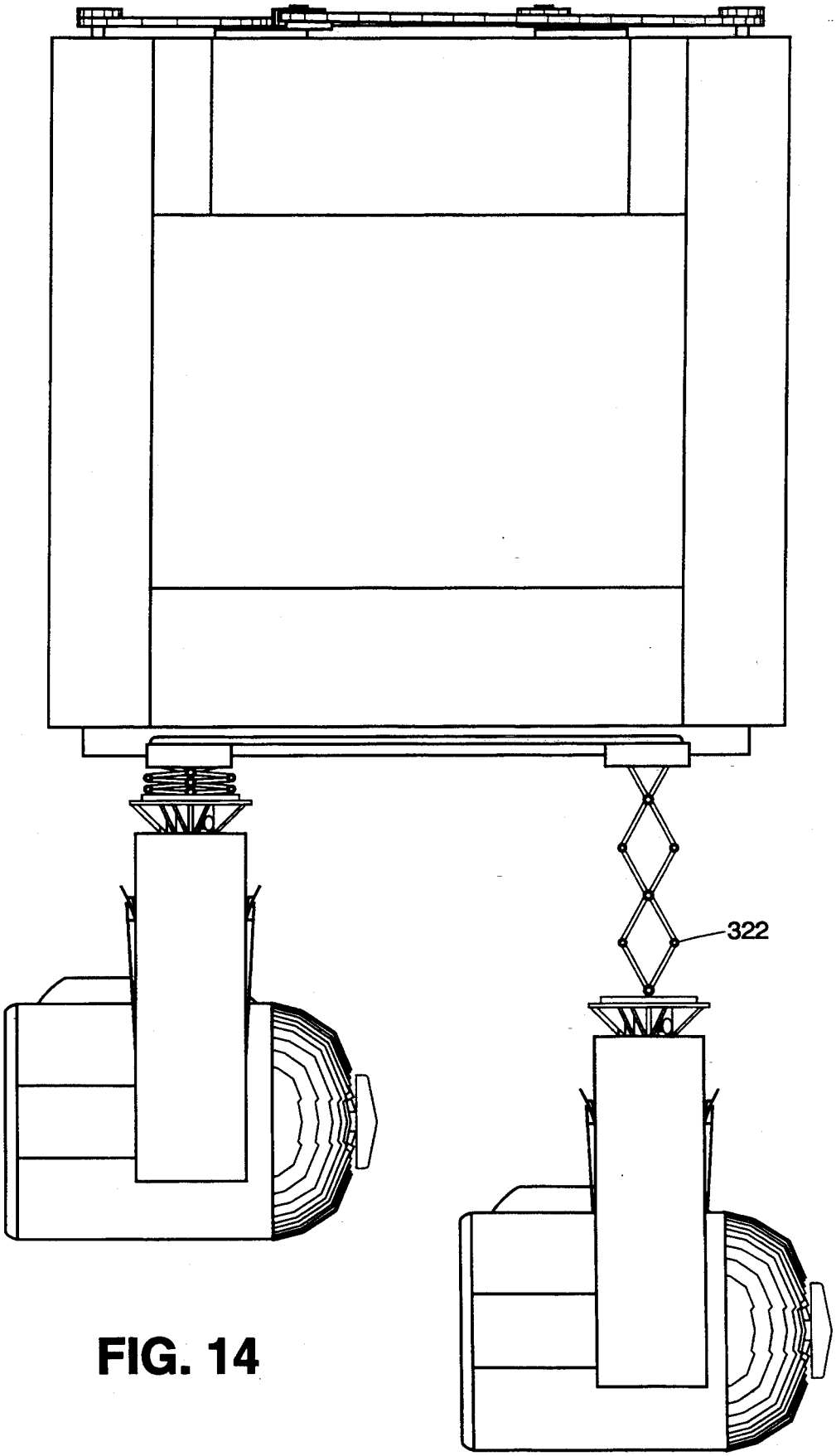
FIG. 14 is another view of the embodiment of FIG. 13.
Figure 15:
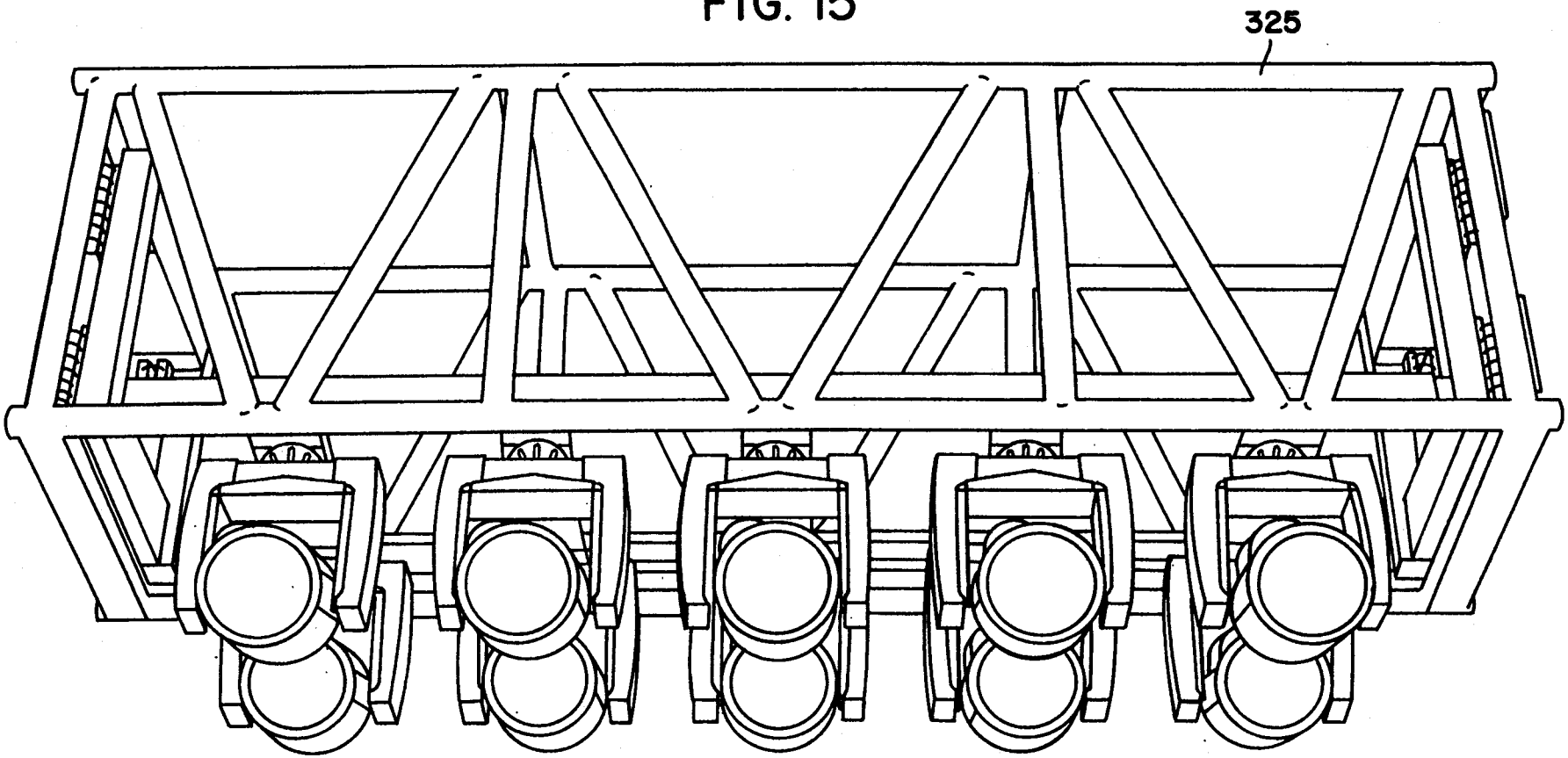
FIG. 15 is another view of the support system and truss of FIG. 10, showing the luminaires in a deployed position.

In the embodiment of FIG. 13, an extension device 322 is provided so that one row of luminaires can be deployed vertically farther from the truss than can the other row, such that each row lies in a different horizontal plane. Thus, extension device 322 allows luminaires in different rows to direct their light beams in generally the same horizontal direction without having luminaires of one row obscure luminaires of the other row. As shown in FIG. 13, the extension device 322 can be an accordion-type extender, operable either manually or by means of a motor. Alternatively, the extension device can be a motor and lead screw, or other suitable extending means. To provide the most flexibility of design, the system can be equipped with extension devices on each luminaire, such that either row of luminaires can be extended beyond the deployed position. The extension device can be operated during performance to withdraw one row and extend the other row of luminaires if it is desired to point both rows of luminaires first in one horizontal direction and then later in an opposite horizontal direction without either row obscuring the other in either direction.

Although several embodiments of the invention have been illustrated in the accompanying drawings and described in the foregoing detailed description, it will be understood that the invention is not limited to the embodiments disclosed, but is capable of numerous rearrangements, modifications and substitutions without departing from the scope of the invention.

We claim:

1. A system for supporting a plurality of multiple parameter lighting instruments, said system comprising:
- a truss;
- a mounting platform mounted within said truss;
- a plurality of lighting instruments coupled to said mounting platform;
- a first drive assembly coupled to said mounting platform for moving said lighting instruments between a stored position within said truss and a deployed position external to said truss; and
- a second drive assembly coupled to said mounting platform for separating a group of said lighting instruments from another group of said lighting instruments when said lighting instruments are in the deployed position.

2. A portable lighting support comprising:
- a truss;
- a plurality of lamp supports movably coupled to the truss;
- a first drive assembly coupled to said lamp supports for moving said lamp supports from a stored position inside of said truss to a deployed position outside of said truss; and
- a second drive assembly coupled to a first one of said lamp supports for moving said one lamp support away from a second one of said lamp supports along a second axis orthogonal to said first axis.

3. The support according to claim 2, wherein when said lamp supports are in the stored position, the lamp supports are arranged in two rows along the length of the truss.

4. The support of claim 3, further comprising a pair of interconnecting members, each one of said interconnecting members being coupled to each luminaire in a respective one of said rows.

5. The support of claim 2, wherein said second drive assembly comprises:
- a motor; and
- a motion translation device coupling said motor and the first and second lamp supports.

6. The support of claim 5, wherein said translation device comprises a ball nut coupled to one of said lamp supports, and a lead screw connecting said motor and said ball nut.

7. The support according to claim 2, further comprising a plurality of luminaires, each of said luminaires coupled to a different one of said lamp supports.

8. The support according to claim 2, wherein said second drive assembly comprises a spring mounted between a pair of said lamp supports.

9. The support of claim 3, wherein said second drive mechanism comprises a spring mounted between said rows.

10. The support according to claim 3, further comprising means for extending one of said rows beyond said deployed position outside of said frame.

11. The support according to claim 7, wherein each of said luminaires includes an associated pan and tilt mechanism.

12. A system for supporting a plurality of multiple parameter lighting instruments, said system comprising:
- means forming a box truss;
- means mounting a plurality of lighting instruments within said box truss;
- means including a drive assembly for moving said mounting means so that said plurality of lighting instruments can be positioned either externally of said box truss or withdrawn within said box truss for protection as desired; and separating means for moving a first group of said lighting instruments away from a second group of said lighting instruments when said plurality of lighting instruments are external to said box truss.

13. The system according to claim 12, wherein said separating means comprises a spring mounted between said first and second groups of lighting instruments.

14. The system according to claim 12, wherein said separating means comprises a motor coupled by a translating device to said first and second groups.

15. The system according to claim 12, wherein said first and second groups consist of one luminaire each.

* * * * *